US006000096A

United States Patent [19]

Everts et al.

[11] Patent Number: 6,000,096

[45] Date of Patent: Dec. 14, 1999

[54] GASOLINE POWERED PARALLEL TUBE BLOWER/VACUUM

[75] Inventors: Robert G. Everts, Chandler; Kenneth M. Brazell, Phoenix; Raul Vidal, Gilbert; Jack B. Sing, Chandler; Taku Ohi, Chandler; Harold J. Coleman, Chandler, all of Ariz.

[73] Assignee: Ryobi North America, Inc., Anderson, S.C.

[21] Appl. No.: 09/129,196

[22] Filed: Jul. 23, 1998

[51] Int. Cl.[6] ..... A47L 5/24; A47L 5/14

[52] U.S. Cl. ..... 15/330; 15/344; 15/410

[58] Field of Search ..... 15/330, 344, 405, 15/410

[56] References Cited

U.S. PATENT DOCUMENTS

| | | | |
|---|---|---|---|
| 4,318,203 | 3/1982 | Satoh et al. | 15/405 |
| 4,644,606 | 2/1987 | Luerken et al. | 15/330 |
| 5,174,255 | 12/1992 | Collins et al. | 15/344 |
| 5,511,281 | 4/1996 | Webster | 15/330 |
| 5,535,479 | 7/1996 | Pink et al. | 15/330 |
| 5,560,078 | 10/1996 | Toensing et al. | 15/330 |
| 5,604,954 | 2/1997 | Webster et al. | 15/330 |
| 5,621,945 | 4/1997 | Howells | 15/339 |
| 5,638,574 | 6/1997 | Haupt et al. | 15/330 |
| 5,701,632 | 12/1997 | Webster | 15/330 |
| 5,722,111 | 3/1998 | Sowell et al. | 15/330 |

FOREIGN PATENT DOCUMENTS 0 792 578 A2 9/1997 European Pat. Off. .

OTHER PUBLICATIONS

IDC Blower Vac, Model 300BV; Owner's Manual, Sep, 1990, 12 pages.

IDC Blower Vac, Model 300BV–2; Parts Manual, no dated, 4 pages.

Ryan Owner's Manual 300/300BV; Gasoline Powered Blower Vac, 1987, 12 pages.

Valex Mistral Sales Brochure, Sep, 1996 GAFA Show, Cologne, Germany, 5 pages.

Operator's Manual for Flymo Garden Va, no date, 20 pages.

*Primary Examiner*—Terrence R. Till
*Assistant Examiner*—Theresa T. Snider
*Attorney, Agent, or Firm*—Brooks & Kushman P.C.

[57] ABSTRACT

Parallel tube type, gasoline powered, blower/vacuums with improved versatility are provided. In one possible feature, a flapper throttle adjacent to the housing for controlling the engine is pivotable from side-to-side with respect to an elongate handle. The elongate handle is sufficiently long to allow a plurality of gripping positions, while the flapper throttle is sufficiently long to allow the operator to access the flapper throttle from different gripping positions on the handle. In another possible feature, a pivotable lever throttle is provided at an interface of the handle forward portion and a transverse grip portion at the handle forward portion end. The lever throttle has a first end accessible to the operator when gripping the transverse grip portion, and a second end accessible to the operator when gripping the handle forward portion. In another possible feature, a blower/vacuum is provided with a rear handle that increases blower/vacuum versatility in that the operator has a plurality of gripping choices available to him.

6 Claims, 4 Drawing Sheets

GASOLINE POWERED PARALLEL TUBE BLOWER/VACUUM

TECHNICAL FIELD

The present invention relates to gasoline powered parallel tube blower/vacuums.

BACKGROUND ART

Existing parallel tube type blower/vacuums are typically powered by an electric motor. The blower/vacuum has a housing with a motor disposed therein, and a fan assembly located at the housing and driven by the motor. An airflow tube connected to the housing forward end, in flow communication with the fan assembly, has a vacuum tube and a blower tube that are parallel and adjacent to each other. A handle is located adjacent to the housing for gripping by the operator.

With existing electric powered parallel tube blower/vacuums, the on/off switch for the electric motor is sometimes difficult for the operator to reach while gripping the blower/vacuum handle. However, this is not a problem because it is not necessary that the operator be able to reach the on/off switch while using an electric blower/vacuum.

However, in a gasoline powered parallel tube blower/vacuum, an operator may wish to adjust the engine throttle while operating the blower/vacuum. As such, existing electric powered parallel tube blower/vacuum designs cannot easily be modified into gasoline powered design having adjustable throttles that an operator may easily reach while gripping the handle.

Further, the handles on existing parallel tube blower/vacuums limit the versatility of the blower/vacuum because the handles are generally small and do not give an operator much choice as to where to place his hands when operating the blower/vacuum.

Although existing parallel tube blower/vacuums have been used in many applications that have been commercially successful, there is a need for gasoline powered parallel tube blower/vacuums that overcome the problems and limitations of the prior art.

DISCLOSURE OF INVENTION

It is, therefore, an object of the present invention to provide a gasoline powered parallel tube blower/vacuum that an operator may grip in a variety of ways while still having easy access to the engine throttle.

It is another object of the present invention to provide a gasoline powered parallel tube blower/vacuum having an elongate handle above the housing and a rear handle to allow multiple ways for the operator to grip the blower/vacuum.

In carrying out at least one of the above objects of the present invention, a blower/vacuum is provided. The blower/vacuum comprises a housing, a gasoline engine, a fan assembly, an airflow tube, an elongate handle, and a pivotable flapper throttle. The housing has a central axis, and has a forward end and a rearward end along the central axis. The gasoline engine is disposed in the housing at the housing rearward end. The engine drives the fan assembly which is located at the housing. The airflow tube connects to the housing forward end and is in flow communication with the fan assembly. Further, the airflow tube is aligned with the central axis, and has a vacuum tube and a blower tube that are parallel and adjacent to each other.

The elongate handle is adjacent to the housing, and is located so as to be above the housing during use of the blower/vacuum by an operator. The handle defines a pair of sides and has a forward portion and a rearward portion. The forward and rearward portions cooperate to define an interior gap between the housing and the handle. The handle is aligned with the central axis and has a length that is sufficiently long to allow the operator to grip the handle forward portion during use of the blower/vacuum as a blower, and to allow the operator to grip the handle rearward portion during use of the blower/vacuum as a vacuum.

The engine is controlled by the flapper throttle which is adjacent to the housing. The flapper throttle is aligned with the central axis and is located within the handle interior gap. The flapper throttle is pivotable from side-to-side with respect to the elongate handle. The flapper throttle has a length that is sufficiently long to allow the operator to pivot the flapper throttle while gripping the handle at either the forward portion or the rearward portion.

Preferably, the blower/vacuum further comprises a transverse grip portion of the handle forward portion that extends substantially perpendicular to the elongate handle. The transverse grip portion allows the operator to grip the handle rearward portion with one hand while gripping the transverse grip portion with the other handle.

Further, in carrying out at least one of the above objects, a blower/vacuum having a housing, a gasoline engine, a fan assembly, an airflow tube, an elongate handle, a transverse grip portion, and a pivotable lever throttle is provided. The pivotable lever throttle is located at an interface of the transverse grip portion and the handle forward portion for controlling the engine. The lever throttle is pivotable about a pivot axis that is substantially perpendicular to the central axis. The lever throttle has a first end above the pivot axis that extends above the handle. The lever throttle has a second end below the pivot axis that extends into the interior gap. The operator may pivot the lever throttle by the lever first end when the operator grips the transverse grip portion, and may pivot the lever throttle by the lever second end when the operator grips the handle forward portion.

Still further, in carrying out at least one of the above objects, a blower/vacuum having a housing, a gasoline engine, a fan assembly, an airflow tube, an elongate handle, and a rear handle is provided. The rear handle is located at the housing rearward end, and is aligned with the elongate handle. The rear handle allows the operator to grip the blower/vacuum with both hands during operation, or with a single hand at the rear of the blower/vacuum.

The advantages associated with embodiments of the present invention are numerous. For example, embodiments of the present invention employing either the flapper throttle or the lever throttle allow the operator to grip the blower/vacuum handle in a plurality of different ways while having ready and easy access to the engine throttle. Further, embodiments of the present invention employing a rear handle at the housing rearward end allow the operator to grip the blower/vacuum in a plurality of different ways. By gripping the blower/vacuum with one hand on the rear handle and one hand at the rearward portion of the elongate top handle, the operator increases his reach with the blower/vacuum. Further, it may be desirable for the operator to grip only the rear handle of the blower/vacuum, depending on the particular work being performed.

The above objects and other objects, features and advantages of the present invention are readily apparent from the following detailed description of the best mode for carrying out the invention when taken in connection with the accompanying drawings.

BEST MODES OF CARRYING OUT THE INVENTION

Figure 1:
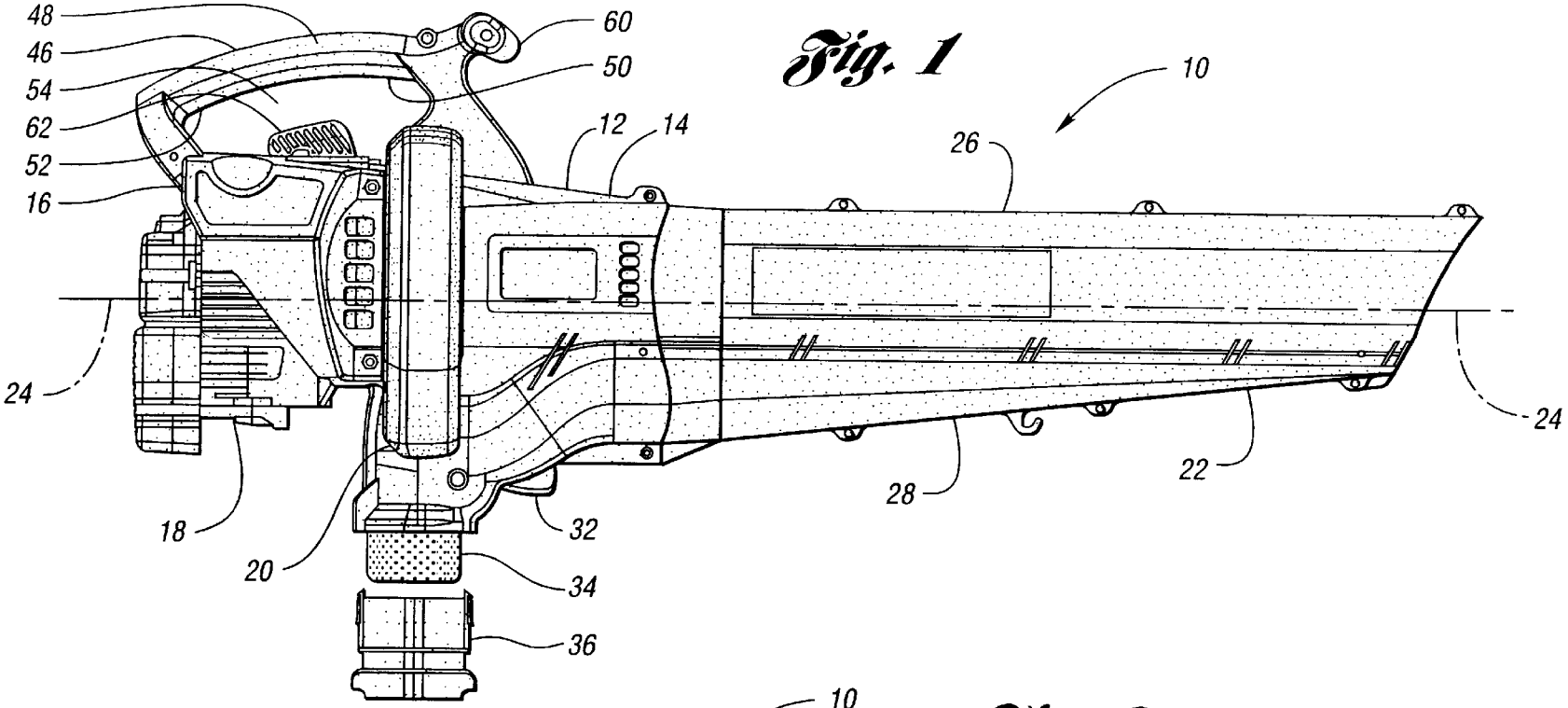
FIG. 1 is a side elevation of gas powered blower/vacuum made in accordance with the present invention.
Figure 2:
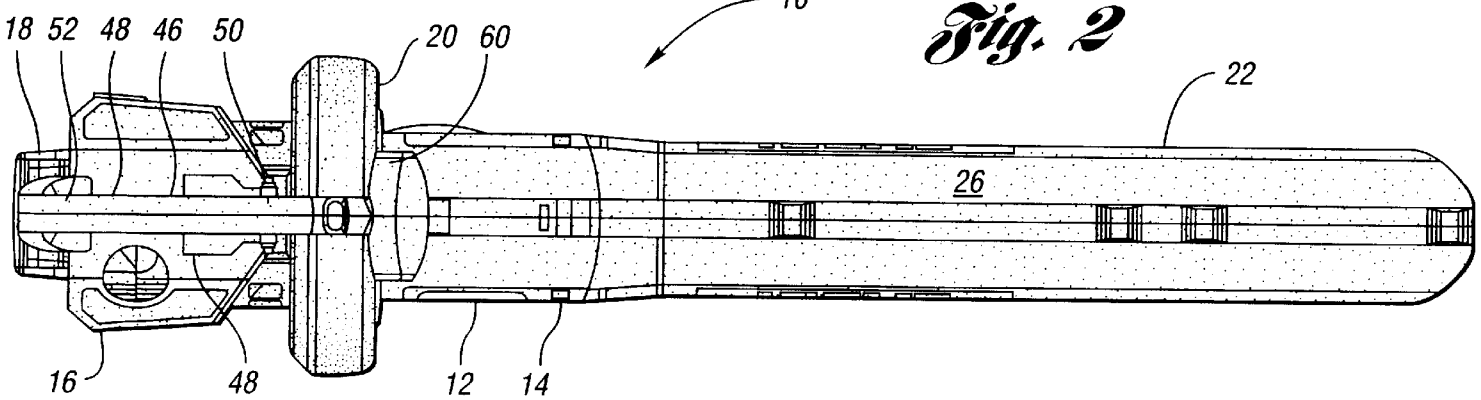
FIG. 2 is a top plan view of the blower/vacuum of FIG. 1.
Figure 3:
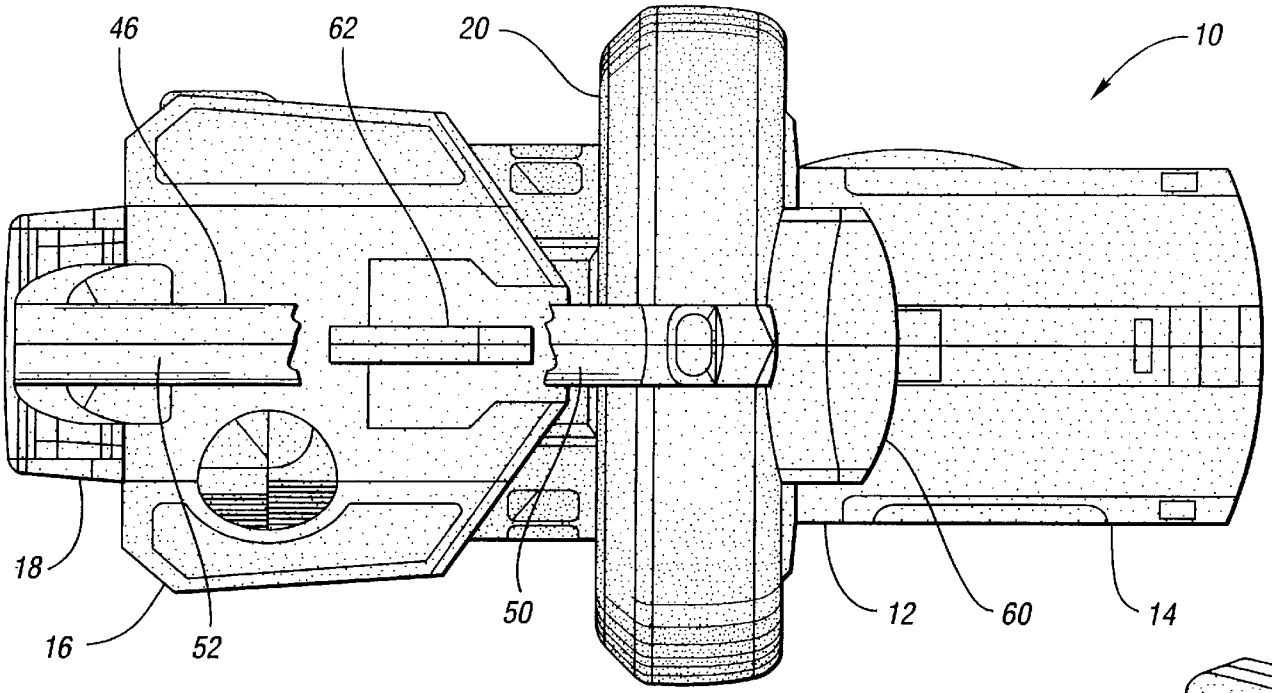
FIG. 3 is an enlarged top view of the blower/vacuum shown in FIG. 1, with a portion of the handle cut-away to show the flapper throttle.

With reference to FIGS. 1–3, a blower/vacuum of the present invention is generally indicated at 10. Blower/vacuum 10 has a housing 12 with a forward end 14 and a rearward end 16. A gasoline engine 18 is disposed in housing 12 at housing rearward end 16. A fan assembly 20 is located at housing 10, and driven by engine 18. An airflow tube 22 is connected to housing forward end 14, and is in flow communication with fan assembly 20.

Housing 12 has a central axis 24; and airflow tube 22 is of the parallel tube type and is aligned with central axis 24. Airflow tube 22 has a vacuum tube 26 and a blower tube 28 that are parallel and adjacent to each other. Airflow tube 22 is attached to housing 12 by screws or any other suitable fastening mechanism. It is go be appreciated that snap-together claws may be used in addition to screws or similar fasteners so that airflow tube 22 will still be secure if the operator forgets to tighten the screws, or other fastener if used.

A lever 32 is pivotable to move an airflow diverter (not specifically shown) to switch blower/vacuum 10 between a blower mode and a vacuum mode. In the blower mode, the airflow diverter is positioned such that air sucked in through vacuum tube 26 is directed out blower tube 28. Because the exit at the end of blower tube 22 is of a much smaller cross-section than the adjacent end of vacuum tube 26, air leaving blower tube 28 is at a much greater velocity than air entering vacuum tube 26. To operate blower/vacuum 10 as a vacuum, the air flow diverter is positioned by moving lever 32 such that air sucked in vacuum tube 26 is directed towards outlet 34. An attachment device 36 may be secured to outlet 34 to facilitate the securement of a bag at outlet 34.

Blower/vacuum 10 has an elongate handle 46 adjacent to housing 12. Handle 46 is located so as to be above housing 12 during use of the blower/vacuum by the operator. Handle 46 defines a pair of sides 48, and has a forward portion 50 and a rearward portion 52. Forward portion 50 and rearward portion 52 cooperate to define an interior gap 54 between housing 12 and handle 46. Handle 46 is aligned with central axis 24 and has a length that is sufficiently long to allow the operator to grip handle forward portion 50 during use of blower/vacuum 10 as a blower, and to allow the operator to grip handle rearward portion 52 during use of blower/vacuum 10 as a vacuum.

In a preferred embodiment of the present invention, a transverse grip portion 60 of handle forward portion 50 extends substantially perpendicular to elongate handle 46. The perpendicularly extending transverse grip portion 60 allows the operator to grip handle rearward portion 52 with one hand while gripping transverse grip portion 60 with the other hand. Of course, it is to be appreciated that transverse grip portion 60 is optional.

Blower/vacuum 10 has a pivotable flapper throttle 62 adjacent to housing 12 for controlling engine 18. Flapper throttle 62 is aligned with central axis 24, and located within handle interior gap 54. Flapper throttle 62 is pivotable from side-to-side with respect to elongate handle 46. Flapper throttle 62 has a length that is sufficiently long to allow the operator to pivot the flapper throttle 62 while gripping elongate handle 46 at either forward portion 50 or rearward portion 52.

It is to be appreciated that cooperation of elongate handle 46 with flapper throttle 62 is very advantageous in that an operator has a variety of different choices for gripping blower/vacuum 10, while having easy and ready access to flapper throttle 62 so that the operator may control engine 18 while operating blower/vacuum 10. That is, the operator can grip forward portion 50 or rearward portion 52 of elongate handle 46 and still be able to reach flapper throttle 62. Further, in embodiments of the present invention that employ the optional transverse grip portion 60, the operator may grip transverse grip portion 60 with one hand, while gripping rearward portion 52 of the elongate handle 46 with the other hand.

Figure 4:
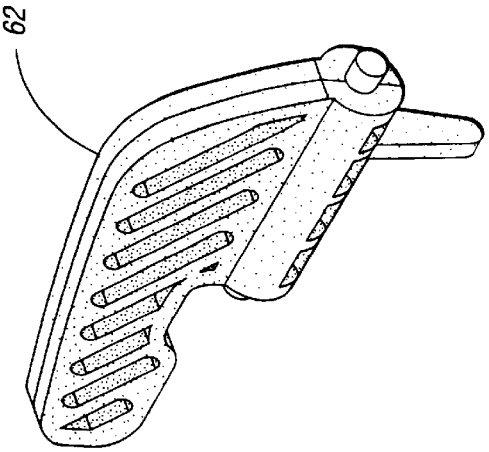
FIG. 4 is a perspective view of the flapper throttle in the blower/vacuum of FIG. 1.

With reference to FIG. 4, a preferred construction for flapper throttle 62 is shown. Of course, flapper throttle 62 may be designed in many different ways, as long as the flapper throttle has a length that is sufficiently long to benefit the operator in that the operator may grip the blower/vacuum in a plurality of different ways while having ready and easy access to the flapper throttle.

Figure 5:
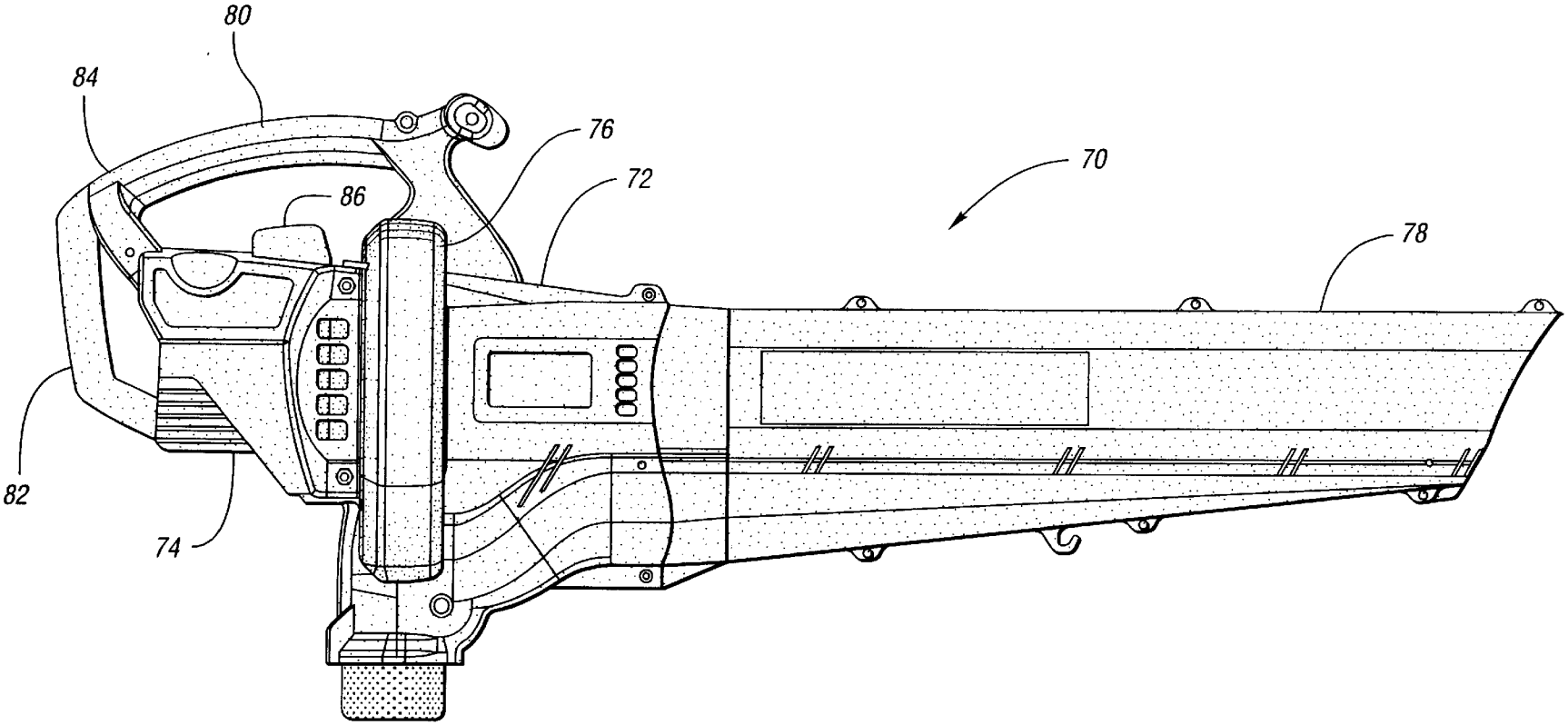
FIG. 5 is a side elevation of a blower/vacuum of the present invention, having a rear handle.
Figure 6:
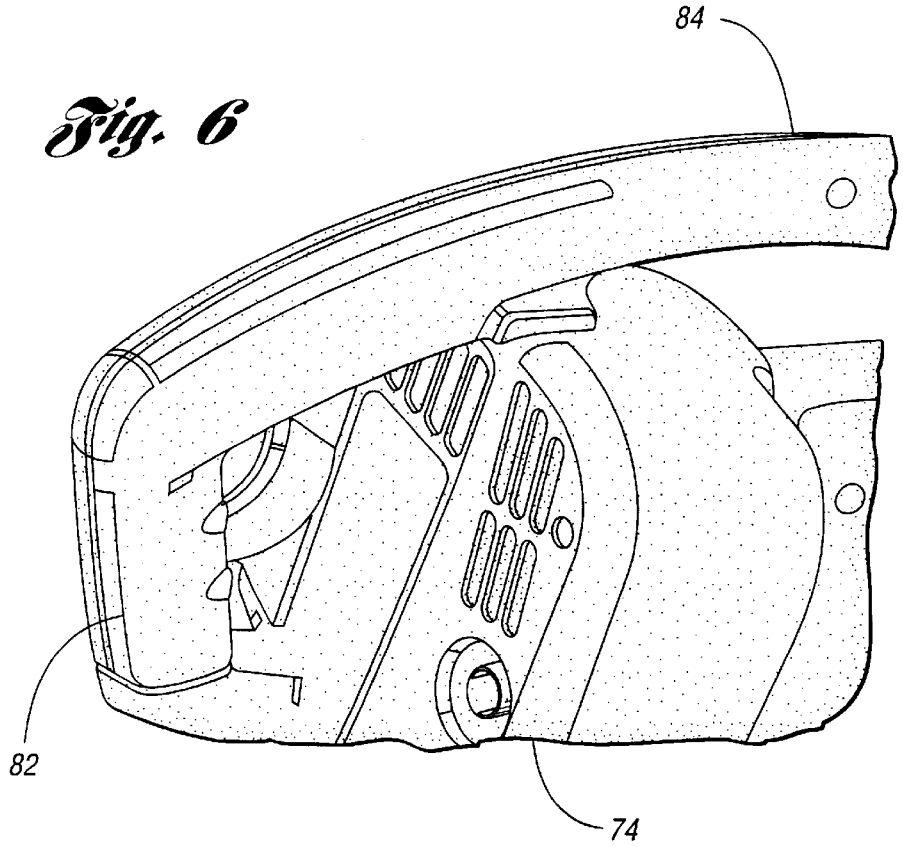
FIG. 6 is an enlarged perspective view of the blower/vacuum of FIG. 5, showing the rear handle in greater detail.

With reference to FIGS. 5–6, another embodiment of the present invention is illustrated. A blower/vacuum of the present invention is generally indicated at 70. Blower/vacuum 70 has a housing 72, a gasoline engine 74, a fan assembly 76, a parallel type airflow tube 78, an elongate handle 80, and a rear handle 82. Blower/vacuum 70 is similar to blower/vacuum 10 (FIGS. 1–3), but blower/vacuum 70 employs rear handle 82 at housing rearward end 84. Rear handle 82 is aligned with the elongate handle 80. It is to be appreciated that rear handle 82 by itself is very advantageous in that rear handle 82 increases the number of choices that an operator has for gripping blower/vacuum 70, and increases the reach of the operator. Further, it is to be appreciated that blower/vacuum 70 may optionally employ a flapper throttle 86 similar to flapper throttle 62 (FIGS. 1–4). That is, it is to be appreciated that blower/vacuum 70 having a combination of flapper throttle 86 and rear handle 82 is preferred; however, either one of flapper throttle 86 or rear handle 82 may be employed without the other to achieve embodiments of the present invention.

Figure 7:
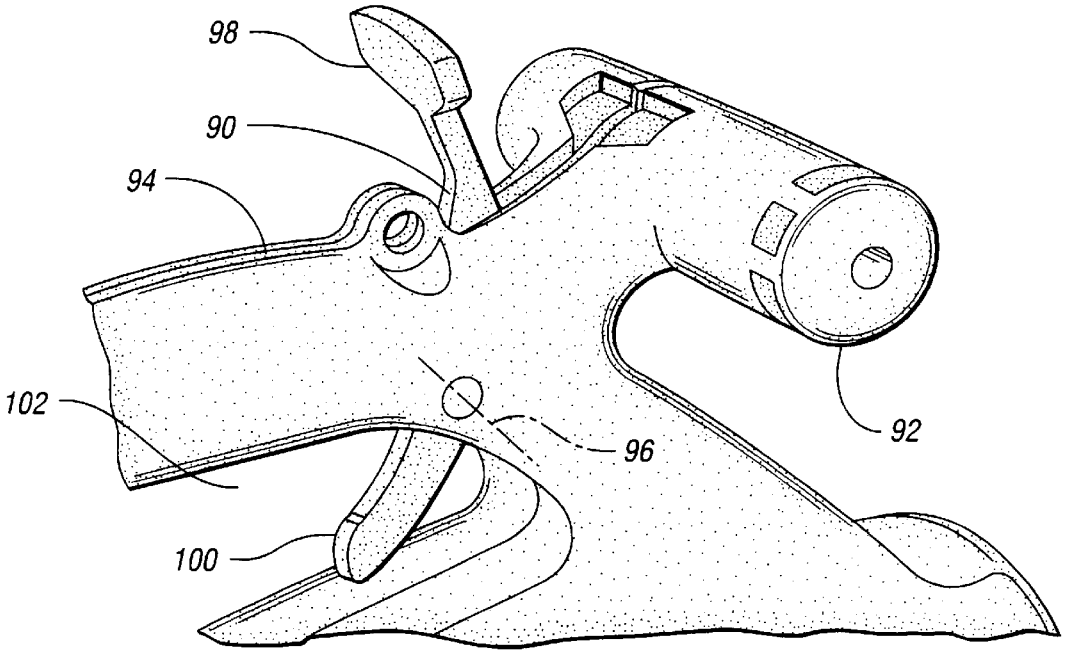
FIG. 7 is an enlarged perspective view of an elongate top handle for a blower/vacuum of the present invention, employing a pivotable lever type throttle in accordance with the present invention.

With reference to FIG. 7, an alternative embodiment for a throttle in accordance with the present invention is illustrated. A pivotable lever throttle 90 may, if desired, be employed in blower/vacuums of the present invention. As mentioned previously with respect to the flapper type throttle (62, FIGS. 1–4; 86, FIG. 5), lever throttle 90 may be employed in blower/vacuums having an elongate handle adjacent to the housing, which may or may not have a rear handle. Of course, it is understood that the use of lever throttle 90 requires that a user need grip either transverse grip portion 92, if provided, or handle forward portion 94 to have ready and easy access to lever throttle 90.

Lever throttle 90 is located at an interface of transverse grip portion 92 and handle forward portion 94 for controlling the engine. Lever throttle 90 is pivotable about a pivot axis 96 that is substantially perpendicular to the blower/vacuum central axis. Lever throttle 90 has a first end 98 above pivot axis 96 that extends above handle front portion 94, and a second end 100 below pivot axis 96 that extends into interior gap 102.

When the operator grips transverse grip portion 92, the operator may pivot lever throttle 90 by first end 98. When the operator grips handle forward portion 94, the operator may pivot lever throttle 90 by second end 100.

While the best mode for carrying out the invention has been described in detail, those familiar with the art to which this invention relates will recognize various alternative designs and embodiments for practicing the invention as defined by the following claims.

What is claimed is:

1. A blower/vacuum comprising:

a housing having a central axis, and having a forward end and a rearward end along the central axis;

a gasoline engine disposed in the housing at the housing rearward end;

a fan assembly located at the housing and driven by the engine;

an air flow tube connected to the housing forward end and in flow communication with the fan assembly, the air flow tube being aligned with the central axis and having a vacuum tube and a blower tube that are parallel and adjacent to each other;

an elongate handle adjacent to the housing, the handle being located so as to be above the housing during use of the blower/vacuum by an operator, the handle defining a pair of sides and having a forward portion and a rearward portion cooperating to define an interior gap between the housing and the handle, the handle being aligned with the central axis and having a length that is sufficiently long to allow the operator to grip the handle forward portion during use of the blower/vacuum as a blower, and to allow the operator to grip the handle rearward portion during use of the blower/vacuum as a vacuum; and a pivotable flapper throttle adjacent to the housing for controlling the engine, the flapper throttle being aligned with the central axis and located within the handle interior gap, the flapper throttle being pivotable from side-to-side with respect to the elongate handle, the flapper throttle having a length that is sufficiently long to allow the operator to pivot the flapper throttle while gripping the handle at either the forward portion or the rearward portion.

2. The blower/vacuum of claim 1 wherein the handle forward portion further comprises:

a transverse grip portion extending substantially perpendicular to the elongate handle to allow the operator to grip the handle rearward portion with one hand while gripping the transverse grip portion with the other hand.

3. The blower/vacuum of claim 1 further comprising:

a rear handle at the housing rearward end, the rear handle being aligned with the elongate handle to allow the operator to grip the blower/vacuum with both hands during operation.

4. A blower/vacuum comprising:

a housing having a central axis, and having a forward end and a rearward end along the central axis;

a gasoline engine disposed in the housing at the housing rearward end;

a fan assembly located at the housing and driven by the engine;

an air flow tube connected to the housing forward end and in flow communication with the fan assembly, the air flow tube being aligned with the central axis and having a vacuum tube and a blower tube that are parallel and adjacent to each other;

an elongate handle adjacent to the housing, the handle being located so as to be above the housing during use of the blower/vacuum by an operator, the handle defining a pair of sides and having a forward portion and a rearward portion cooperating to define an interior gap between the housing and the handle, the handle being aligned with the central axis and having a length that is sufficiently long to allow the operator to grip the handle forward portion during use of the blower/vacuum as a blower, and to allow the operator to grip the handle rearward portion during use of the blower/vacuum as a vacuum;

a transverse grip portion extending substantially perpendicular to the elongate handle at the handle forward portion to allow the operator to grip the handle rearward portion with one hand while gripping the transverse grip portion with the other hand; and a pivotable lever throttle at an interface of the transverse grip portion and the handle forward portion for controlling the engine, the lever throttle being pivotable about a pivot axis that is substantially perpendicular to the central axis, the lever throttle having a first end above the pivot axis and extending above the handle and a second end below the pivot axis and extending into the interior gap to allow the operator to pivot the lever throttle by the lever first end when the operator grips the transverse grip portion, and to allow the operator to pivot the lever throttle by the lever second end when the operator grips the handle forward portion.

5. The blower/vacuum of claim 4 further comprising:

a rear handle at the housing rearward end, the rear handle being aligned with the elongate handle to allow the operator to grip the blower/vacuum with both hands during operation.

6. A blower/vacuum comprising:

a housing having a central axis, and having a forward end and a rearward end along the central axis;

a gasoline engine disposed in the housing at the housing rearward end;

a fan assembly located at the housing and driven by the engine;

an air flow tube connected to the housing forward end and in flow communication with the fan assembly, the air flow tube being aligned with the central axis and having a vacuum tube and a blower tube that are parallel and adjacent to each other;

an elongate handle adjacent to the housing, the handle being located so as to be above the housing during use of the blower/vacuum by an operator, the handle defining a pair of sides and having a forward portion and a rearward portion cooperating to define an interior gap between the housing and the handle, the handle being aligned with the central axis and having a length that is sufficiently long to allow the operator to grip the handle forward portion during use of the blower/vacuum as a blower, and to allow the operator to grip the handle rearward portion during use of the blower/vacuum as a vacuum; and a rear handle at the housing rearward end, the rear handle being aligned with the elongate handle to allow the operator to grip the blower/vacuum with both hands during operation.

* * * * *